US007187885B2

(12) United States Patent
Baker et al.

(10) Patent No.: US 7,187,885 B2
(45) Date of Patent: Mar. 6, 2007

(54) OXIDATION OF VOLATILE ORGANIC COMPOUNDS IN ELECTROGRAPHIC PRINTING

(75) Inventors: James A. Baker, Hudson, WI (US); Truman F. Kellie, Lakeland, MN (US); Robert E. Brenner, New Richmond, WI (US)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/977,978

(22) Filed: Oct. 29, 2004

(65) Prior Publication Data

US 2006/0093392 A1 May 4, 2006

(51) Int. Cl.
*G03G 21/20* (2006.01)

(52) U.S. Cl. ..... 399/93; 399/98

(58) Field of Classification Search ..... 399/93, 399/98

See application file for complete search history.

(56) References Cited

U.S. PATENT DOCUMENTS

| | | | | |
|---|---|---|---|---|
| 3,733,181 | A * | 5/1973 | Tourtellotte et al. | 422/171 |
| 4,364,995 | A | 12/1982 | Crawford et al. | 428/336 |
| 4,413,048 | A | 11/1983 | Landa | 430/115 |
| 4,420,244 | A | 12/1983 | Landa | 399/249 |
| 4,645,932 | A | 2/1987 | Ellis et al. | 250/361 R |
| 4,752,588 | A | 6/1988 | Ellis et al. | 436/172 |
| 4,760,423 | A | 7/1988 | Holtje et al. | 399/250 |
| 4,780,643 | A | 10/1988 | Ellis et al. | 313/503 |
| 5,176,974 | A | 1/1993 | Till et al. | 430/42 |
| 5,432,591 | A | 7/1995 | Geleynse | 399/249 |
| 5,737,674 | A | 4/1998 | Venkatesan et al. | 399/250 |
| 5,916,718 | A | 6/1999 | Kellie et al. | 430/45 |
| 6,237,397 | B1 | 5/2001 | Shinar et al. | 73/24.06 |
| 6,255,363 | B1 | 7/2001 | Baker et al. | 523/201 |
| 6,432,362 | B1 | 8/2002 | Shinar et al. | 422/82.01 |
| 6,577,828 | B1 * | 6/2003 | Ramos | 399/93 |
| 2002/0000066 | A1 * | 1/2002 | Bentley et al. | 48/61 |
| 2003/0091363 | A1 * | 5/2003 | Hoffman et al. | 399/93 |
| 2004/0047645 | A1 | 3/2004 | No et al. | 399/93 |

OTHER PUBLICATIONS

U.S. Appl. No. 10/879,895, filed Jun. 29, 2004, Brenner.

* cited by examiner

*Primary Examiner*—David M. Gray
*Assistant Examiner*—Ryan D. Walsh
(74) *Attorney, Agent, or Firm*—Mark A. Litman & Associates, P.A.

(57) ABSTRACT

An apparatus for oxidizing volatile organic compounds from an electrographic printer may comprising a) a printer system that vents a gas stream containing volatile organic compounds to a first inlet; b) a first mast transfer element transmitting the gas stream to a catalytic treatment system, c) The catalytic treatment system comprising separate contact sections for an unsupported catalyst and a supported catalyst; a diverter system that can direct the gas stream along paths selected from the group consisting of to the unsupported catalyst only, to the supported catalyst only, first the unsupported catalyst and then the supported catalyst, and the supported catalyst and then the unsupported catalyst.

27 Claims, 3 Drawing Sheets

Figure 1
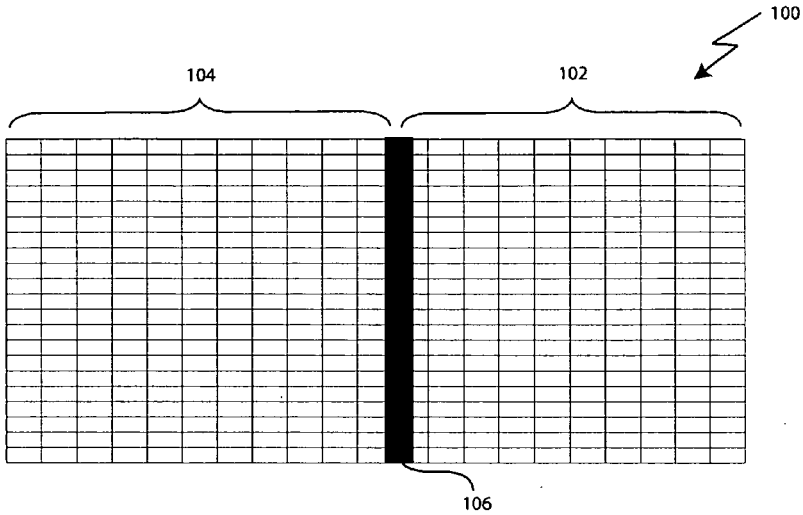
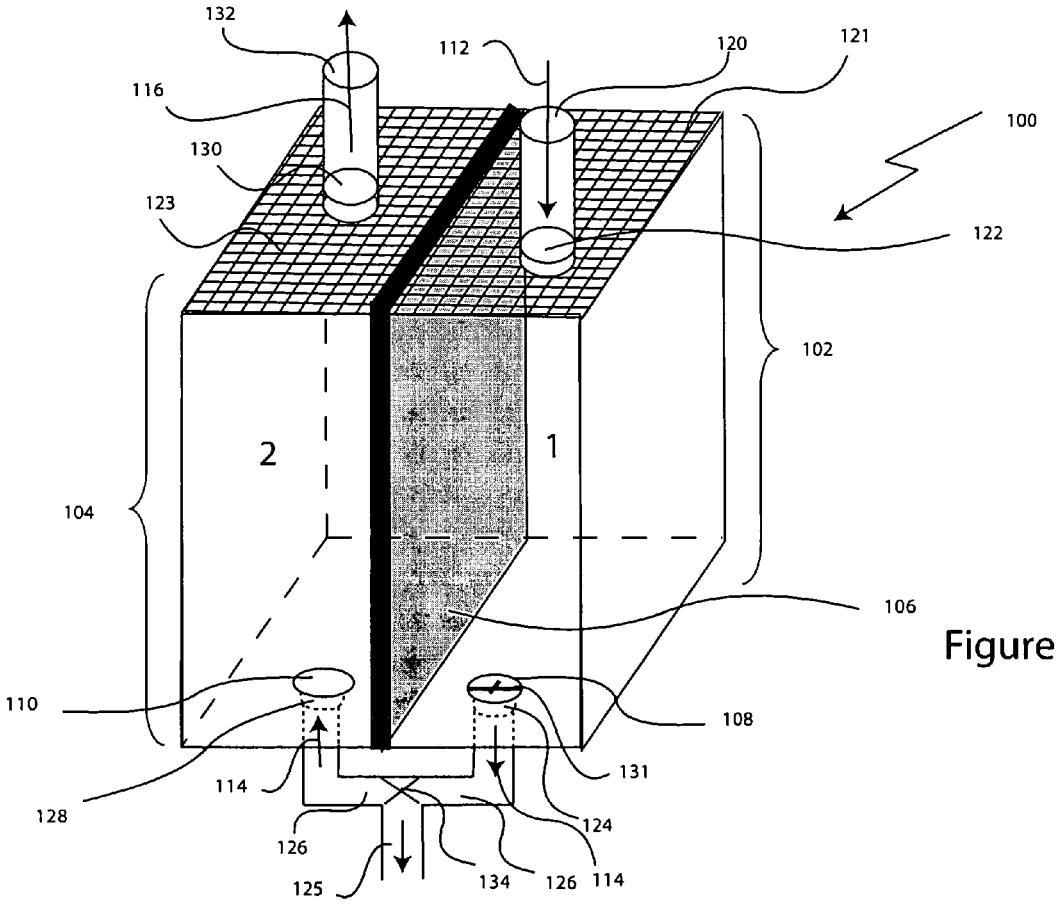
Figure 2

OXIDATION OF VOLATILE ORGANIC COMPOUNDS IN ELECTROGRAPHIC PRINTING

BACKGROUND OF THE INVENTION

1. Field of the Invention

The present invention relates to electrographic printing. More particularly, the invention relates to efficient removal of volatile organic compounds from the exhaust of an electrographic printer.

2. Background of the Art

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor to develop the latent image. An exemplary electrostatic imaging process is described in U.S. Pat. No. 5,176,974.

In contrast, electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with a charge of a desired polarity, either negative or positive, typically with a corona charge applicator or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which may also be referred to as "light", may include infrared radiation, visible light, and ultraviolet radiation, for example.

In the development step, toner particles of the appropriate polarity are generally brought into contact with the latent image on the photoreceptor, typically using a developer electrically-biased to a potential opposite in polarity to the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to affect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative energies between the ink, a photoreceptor surface and a temporary carrier surface or medium for the toner. The effectiveness of such elastomeric assist or adhesive transfer is controlled by several variables including surface energy, temperature, pressure, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer may be influenced by surface energy, temperature, and pressure, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed. Finally, in the erasing step, the photoreceptor charge is reduced to a substantially uniformly low value by exposure to light of a particular wavelength band, thereby removing remnants of the original latent image and preparing the photoreceptor for the next imaging cycle.

Electrophotographic imaging processes may also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either via an intermediate transfer member or directly. One example of such a process is described in U.S. Pat. No. 5,432,591.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically nonconductive dispersant, to avoid discharging the latent electrostatic image. Liquid toner particles are generally solvated to some degree in the liquid carrier (or carrier liquid); typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227–252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter between 0.1–1 microns. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68–74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter between 3–10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

Photoreceptors generally have a photoconductive layer that transports charge (either by an electron transfer or charge transfer mechanism) when the photoconductive layer is exposed to activating electromagnetic radiation or light. The photoconductive layer is generally affixed to an electroconductive support, such as a conductive drum or an insulative substrate that is vapor coated with aluminum or another conductor. The surface of the photoreceptor can be either negatively or positively charged so that when activating electromagnetic radiation strikes certain regions of the photoconductive layer, charge is conducted through the photoreceptor to neutralize, dissipate or reduce the surface potential in those activated regions.

Many electrophotographic imaging processes make use of intermediate transfer members (ITM's) to assist in transferring the developed toner image to the final image receptor. In particular, in a multipass electrophotographic process, these ITM's may contact the final image formed on the photoreceptor to assist transfer of entire image to transfer to the ITM. The image may then be transferred from the ITM to the final image receptor, typically through contact between the ITM and the final receptor.

In a tandem process, individual photoreceptors layer the images formed by the component colors on the ITM. When the entire image is composed in this manner it is typically transferred to the final image receptor. U.S. Pat. No. 5,432,591, for example, discloses the use of an offset roller to remove the entire image from a photoreceptor and transfer it to the final image receptor in a multi-pass liquid electrophotographic process. In various embodiments, the ITM may be an endless belt, a roller or a drum.

One continuing problem in liquid electrophotography is that the hydrocarbon liquid developers are highly volatile and fairly high concentrations of hydrocarbon molecules, called VOC's (volatile organic compounds), may enter the ambient air during the electrographic process and may constitute an environment hazard. Some airborne VOC's are produced by natural evaporation in and around the electrographic drum or belt, some from the dispensing of the liquid carrier, and some from evaporation of the liquid during fusing of the print to the sheet when the image is dried and this is most notably the biggest cause for the evaporation. This creates an environmental hazard during continued use that becomes more severe with increased usage and speeds of the printer. In addition, the evaporation of the VOC's also may cause a very objectionable smell. In liquid electrophotography, the hydrocarbon vapors must be captured not only at the fusing operation of the process but at all points where there are fugitive emissions of the hydrocarbon vapors.

The World Health Organization definition of VOCs includes all organic compounds (substances made up of predominantly carbon and hydrogen) with boiling temperatures in the range of 20–260° C., excluding pesticides. This means that they are likely to be present as a vapor or gas in normal ambient temperatures. People are exposed to the VOC's by breathing the contaminated air. The health effects depend on the specific composition of the VOC's present, the concentration, and the length of exposure. High concentrations of some compounds could have serious health effects. General effects include eye, nose and throat irritation, headaches, loss of coordination, nausea, damage to the liver, kidneys and central nervous system and some are suspected or known to cause cancer in humans.

The Occupational Safety and Health Association (OSHA) has formulated PELs (permissible exposure limit) and IDLHs (immediately dangerous to life of health) for separate organic compounds but not for total VOC exposure. The American Conference of Governmental Industrial Hygienists (ACGIH) has established TLV-TWA (Threshold Limit Value-Time Weighted Average) values and STEL (Threshold Limit Value, Short Term Exposure Limit) for single compounds but do not take into account the effects of simultaneous or serial exposure to complex mixtures and has not established values for total VOC exposure. The World Health Organization has not established guidelines for total VOC exposure.

The art continues to search for methods and apparatus for economically and efficiently reducing the VOC's from hydrocarbon carriers in liquid electrographic printers. For example, one approach involves condensation of the hydrocarbon vapors (refer to U.S. Pat. No. 5,737,674). Alternatively, the art teaches absorption or adsorption of the hydrocarbon vapors into another material such as carbon (refer to U.S. Pat. No. 4,760,423). Another alternative involves catalytic oxidation of the hydrocarbon vapors to carbon dioxide and water (refer to U.S. Pat. Application Publication US2004/0047645A1).

Background information on catalytic oxidation is documented in Hodnett, Kieran K. and Hodnett, B. K., *Heterogeneous Catalytic Oxidation: Fundamental & Technological Aspects of the Selective & Total Oxidation of Organic Compounds*, John Wiley & Sons Inc., 2000 and Warren, Barbara K and Oyama, Ted S., *Heterogeneous Hydrocarbon Oxidation*, Oxford University Press, 1996, and Spivy, James J., "Complete Catalytic Oxidation of Volatile Organics", *Industrial Engineering and Chemistry Research*, 26, pp 2165–2180 1987, and *Journal of Hazardous Materials*, Vol 109, Issue 1–3, p 113, June 2004.

SUMMARY OF THE INVENTION

The presently described technology involves an apparatus and method for the oxidation of VOC's from a printer and particularly a liquid electrographic printer using a combination of an unsupported oxidation catalyst and a supported oxidation catalyst. In addition, there is described a method of dividing the supported oxidation catalyst into sections to obtain efficient oxidation of volatile organic compounds.

Described technology includes an apparatus for oxidizing volatile organic compounds from the exhaust of an electrographic printer comprising a printer body venting exhaust gas through a vent. Gas from within the printer body is transmitted by a mass transfer element to a catalytic treatment system comprising separate contact regions for an unsupported oxidation catalyst and a supported oxidation catalyst. The unsupported oxidation catalysts are in ultimate mass transfer communication with each other and with the vent. Catalytically treated or decomposed or reacted vapor from the catalyst treatment system is ultimately vented from the printer body.

A catalyst conversion component or region within a solvent treatment system may comprise both a supported and unsupported catalyst region. This may be provided, by way of non-limiting example, as a supported oxidation catalyst that has a plurality of sections which may be controllably connected through a mass transfer communication path. The individual catalyst areas may have sections or regions of the various catalyst types or different catalysts through which flow may be controlled and regulated as needed. The sections may be arranged in a sequence of catalyst regions that can be controllably interconnected across boundaries that may otherwise prevent direct flow of vented gas or vapor streams between the regions. This can be accomplished by segmenting catalyst regions as with boundaries of the sections that are substantially impervious to the gas or vapor stream containing the volatile organic compounds. The system may provide a gas motive power source to move the air containing the volatile organic compounds through the sections or segments of the catalyst materials as directed.

BRIEF DESCRIPTION OF THE DRAWINGS

The construction and operation of the presently described technology will become more readily apparent from the following non-limiting description and accompanying drawings in which:

FIG. 1 is a top view of a box-like monolith oxidation catalyst, in which the shape of a cross section perpendicular to the flow of the air containing the volatile organic compounds is a rectangle, and the monolith oxidation catalyst is divided into two sections.

FIG. 2 is a perspective view of a box-like monolith oxidation catalyst, in which the shape of a cross section perpendicular to the flow of the air containing the volatile organic compounds is a rectangle, and the monolith oxidation catalyst is divided into two sections.

DETAILED DESCRIPTION OF THE INVENTION

Figure 3:
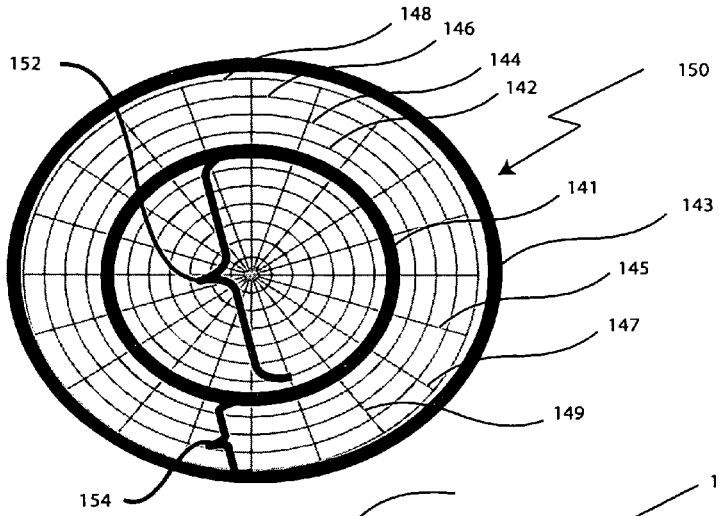
FIG. 3 is a top view of a cylindrical monolith oxidation catalyst, in which the shape of a cross section perpendicular to the flow of the air containing the volatile organic compounds is a circle, and the monolith oxidation catalyst is divided into two sections.

The presently described technology involves an apparatus and method for the oxidation of VOC's from a printing environment, both with dry toners that contain residual solvent from manufacture and in a liquid electrographic printer. The described technology uses a combination of an unsupported oxidation catalyst and a supported oxidation catalyst for reduction in content of the undesirable solvent in any vented or collected waste stream from the printer. In addition, there is described a method of dividing the supported oxidation catalyst into sections to obtain efficient oxidation of volatile organic compounds. The sections may be controllably accessed within the system to allow for rapid treatment of vapor emissions and rapid response to different volume requirements for treatment of vapor emission.

The World Health Organization (WHO) definition of VOC's includes all organic compounds (substances made up of predominantly carbon and hydrogen) with boiling temperatures in the range of 20–260° C., excluding pesticides. This means that they are likely to be present as a vapor or gas in normal ambient temperatures. The VOC's are poisonous chemical substances that pollute the air, cause health problems when inhaled, and may cause cancer and death. While the carrier liquid is substantially odorless, when it is heated during a fusing or evaporation step, the organic components evaporate at different rates. The worst smelling organic compounds are the first to reach the operator. Removal of all VOC effluent is the solution to the environmental problem and the smell problem.

During the imaging and development process, for example as when the printing medium and the image thereon are passed through the heated fusing roller in a liquid toner electrographic printer, the carrier liquid dissipates as vapor. Usually liquid toners comprise a VOC in the carrier liquid or as a residual material; many dry toners and imaging and development processes also generate vapor containing undesirable types or amounts of VOC's. The VOC's in the vapor from the carrier may, by way of non-limiting example, comprise one or more of benzene, toluene, styrene, ethylene, phenol, methanol, formaldehyde, acetone, methylethyl ketone, and acetic acid. The carrier liquid often comprises a liquid aliphatic hydrocarbon such as NORPAR® 12, NORPAR® 13, or NORPAR® 15, or an isoparaffinic hydrocarbon such as ISOPAR® G, ISOPAR® H, ISOPAR® L, or ISOPAR® M. These solvent/carrier products are registered trademarks of the Exxon Company (Houston, Tex.). NORPAR® 12 and NORPAR®13 comprise a narrow cut of aliphatic hydrocarbons and ISOPAR® G comprises a narrow cut of isoparaffinic hydrocarbons. They must be dielectric, non-polar, and be of exceptionally high purity with substantially no aromatic impurities such as benzene or toluene and no objectionable impurities such as sulfur which might poison an oxidation catalyst or otherwise be oxidized to sulfur dioxide.

Oxidation catalysts oxidize the volatile organic compounds to carbon dioxide and water when the catalyst is heated to its activation temperature. Oxidation catalysts can be either unsupported or supported catalysts. The unsupported catalysts are made of essentially only the catalytic material; the air containing the volatile organic compounds comes in direct contact with the structure of the unsupported catalyst which catalyzes the oxidization of the volatile organic compounds. There is no additional non-catalytic material applied to the structure of the unsupported catalyst. Supported catalysts have a catalytic material applied to a non-catalytic support of the catalyst. The support of the catalyst is also called a carrier or carrier substrate.

Manufacturers of all types of oxidation catalysts include Johnson Matthey, Orchard Road, Royston, Herts SG8 5HE, England (in the U.S., the address is 380 Lapp Road, Malvern, Pa. 19355), Engelhard-CLAL, 700 Blair Rd., Carteret, N.J. 07008, and Cordona Associates, Inc. (CAI), P.O. Box 126, Frederick, Pa. 19435-0126. A manufacturer of wire mesh substrate catalysts is China Chemical Supply & Sale, Tai Yuan Precious Metal Co. Ltd, 148# Caiyuan West St., Tai Yuan SanXi. China 030012. A manufacturer of monolith oxidation catalysts is Catalytic Products International, 980 Ensell Rd., Lake Zurich, Ill. 60047-1557.

In one embodiment, the VOC oxidation apparatus may include multiple venting and outlet connections within a catalytic conversion system. For example, there my be a first inlet from the printer vapor stream to a first catalytic segment, an outlet from the first catalytic segment to a second inlet to a second catalytic segment and a vent from the second catalytic segment. There may be more than two catalytic segments and appropriate controllable venting between the segments and ultimate resolution of the mass transfer of the gas or vapor stream from the system. There may also be a single or multiple pumps or gas flow controls (both moving gas flow and directing gas flow) between the various segments and components of the system.

For example, there may be a gas flow diverter between the various segments of the catalyst system. The gas flow diverter can selectively pass or direct any vapor or gas stream, including an air stream, to the desired segments or components of the system as directed by an operator or by automated (e.g., processor directed, software directed, hardware directed) controls. The use of gas flow diverters can enable or allow the unsupported oxidation catalyst and the supported oxidation catalyst to be arranged in a controlled series arrangement with, for example, the unsupported oxidation catalyst being first or second in the series and the supported oxidation catalyst being second or first in the series (respectively) and the diverter system allows the unsupported oxidation catalyst and the supported oxidation catalyst to be controllably arranged in parallel if needed.

When the unsupported oxidation catalyst and the supported oxidation catalyst are used in series, a gas flow diverter between a first catalytic segment and a second catalytic segment may be controlled to pass substantially all of the gas stream from the first catalytic segment to a gas inlet in the second catalytic segment. When the unsupported catalyst is chosen to be the first catalyst segment in the series, this arrangement allows the unsupported oxidation catalyst to oxidize the volatile organic compounds first and then the stream of at least partially oxidized vapor is transmitted to the supported oxidation catalyst for a second round of catalytic oxidation.

The unsupported oxidation catalyst can normally be heated quickly to a temperature sufficient to provide efficient oxidation of the volatile organic compounds because unsupported catalysts tend to have more thermally conductive properties than supported catalysts, have easily controlled mass (and therefore controllable heat capacity), and can be used with as little mass as the system is designed for, since it may act as the first line of catalytic activity (e.g., where lower volumes of vapor are provided or during start-up times). It is therefore not necessary for the unsupported catalyst to provide a large amount of oxidation capacity. The supported oxidation catalyst is not normally able to be heated quickly to a temperature sufficient to provide efficient oxidation of volatile organic compounds and yet it normally has a large amount of oxidation capacity. When the unsupported oxidation catalyst is first in the series and the supported oxidation catalyst is second in the series, the supported oxidation catalyst has time to reach a temperature sufficient to provide efficient oxidation of volatile organic compounds. Additionally, some of the heat energy may be provided by the gas stream from the unsupported catalyst, by convection, by conduction, by reaction energy, or by resistance heating, to expedite the rate at which the supported oxidation catalyst reaches its optimum temperature.

When the unsupported oxidation catalyst and the supported oxidation catalyst are used in parallel, a gas flow diverter in the third gas conduit may selectively pass air to the appropriate gas inlets and outlets. The air containing the volatile organic compounds may pass through only one catalyst and then be passed through a vent to outside of the printer when so desired. The gas flow diverter may even selectively pass air to two different locations. There are different types of gas valves for use as a gas flow diverter. Some of the different types of gas valves include a ball valve, butterfly valve, gate valve, angle valve, check valve, globe valve, and stop valve. Manufacturers of gas valves include Maxon Corp., 201 E. 18$^{th}$ St., Muncie, Ind. 47307, Tate-Jones, Inc., 4065 Windgap Ave., Pittsburgh, Pa. 15204, A. Y. McDonald Manufacturing Co., 4800 Chavenelle Rd., Box 508, Dubuque, Iowa 52001, ABZ Valves & Controls, A division of ABZ Manufacturing, Inc., P.O. Box 157, Madison, Kans. 66860, Fairview Fittings & Manufacturing Limited, 449 Attwell Dr., Etobicoke, ON M9W 5C4, Conval Quebec, 3115 Sartelon, Saint-Laurent, QC H4R 1E7, and Carremm Controls Limited, 1578 Finfar Court, Unit #3, Mississauga, ON L5J 4K1.

The unsupported oxidation catalyst may be of any convenient structure. By way of non-limiting examples, the unsupported oxidation catalyst may be in the form of a plurality of particles, woven or non-woven fabric, a single wire, a 2-dimensional array of wires, and a 3-dimentional array of wires. The catalytic metal used for the composition of the unsupported oxidation catalyst includes, by way of non-limiting examples, any oxidizing catalyst material such as platinum, palladium, rhodium, ruthenium, copper, chromium, cerium, manganese, iron, nickel, tin, zinc, aluminum, zirconium, tungsten, vanadium and alloys thereof.

The supported oxidation catalyst may, by way of non-limiting examples, be a monolith catalyst with a support material and catalytic material thermally engaged to the support material. The supported oxidation catalyst may have an anchor coat between the support material and the catalytic material. The support material is typically a ceramic material and it can include at least one of the following: sillimanite, petalite, cordierite, corierite-alpha-alumina, silicon nitride, zirconium mullite, mullite, zircon, zircon mullire, spodumene, alumina-titanate, alumina-silica magnesia, zirconium silicate, sillimanite, magnesium silicates, zirconium oxide, petallite, silica, alumina, and alumino-silicates. The catalytic metal that is used for the supported oxidation catalyst includes at least one metal from the group including platinum, palladium, rhodium, ruthenium, copper, chromium, cerium, manganese, iron, nickel, tin, zinc, aluminum, zirconium, tungsten, vanadium and alloys thereof. The weight loading of the catalytic material is in the exemplary non-limiting range of from about 0.1 to about 20.0 weight percent, preferably about 5.0 to about 10.0 weight percent of the support material.

Preferably, the unsupported oxidation catalyst and supported oxidation catalyst are heated to a temperature sufficient to provide efficient oxidation of volatile organic compounds. The oxidation of the volatile organic compounds within an oxidation catalyst is an exothermic reaction which greatly increases the temperature of the air in and around the catalyst. The heated air from the catalysts generally supplies all the heat needed to maintain an efficient oxidation temperature after initial heat-up and continued application of external heat energy is usually not needed.

The typical but not exclusive minimum temperature range for an oxidation catalyst is 200–220° C. (390–430° F.), the optimum temperature range is 290–310° C. (560–590° F.), and the maximum temperature range is typically 500–600° C. (930–1100° F.). One skilled in the art knows that a higher temperature will generally increase the oxidation rate and efficiency. The maximum temperature range of 500–600° C. will promote efficient oxidation where the VOC exit exhaust concentration is normally less than 30 ppm. The optimum temperature range of 290–310° C. will promote oxidation, but it is not necessarily as efficient as the maximum temperature range. The minimum temperature range of 200–220° C. will promote oxidation but it is not as efficient as the optimum temperature range. Undesirable coking or fouling of the oxidation catalyst may occur if the catalyst temperature is maintained below the optimum range for a prolonged period, leading to reduced catalyst oxidation efficiency. If the temperature is higher than 600° C., the support material may become damaged and the catalytic material may crack, melt, and become damaged. In one embodiment, the temperature of the unsupported oxidation catalyst and the supported oxidation catalyst is 200–600° C. (390–1100° F.).

The unsupported oxidation catalyst may be heated by conduction, convection, or both. The unsupported catalyst may be heated conductively via the heat generated by its own oxidization of VOCs, via the heat generated by the supported catalyst's oxidization of VOC's, or via electrical resistance heating. Fans or pumps (with or without ductwork) may be used to convectively move heat from the supported catalyst or an electrical resistance heater to the unsupported catalyst. One skilled in the art will know that electrical resistance heating would work by passing an electrical current through the metallic wires of the unsupported oxidation catalyst or by inserting wires in the unsupported oxidation catalyst and passing an electrical current through the wires. Finally, the supported catalyst may be heated convectively by passing air through a heat exchanger before passing it through the unsupported oxidation catalyst.

The supported oxidation catalyst may be heated in the same ways the unsupported catalyst is heated, by convection or conduction of heat from the unsupported catalyst, or electrical resistance heating. The supported catalyst, because it is larger and requires more energy to heat, may additionally be heated by radiation, through use of a heat lamp. More than one method of heating may be used to initially heat or maintain the heat of the supported catalyst.

A heat exchanger may be used to adjust the temperature of the vapor containing the volatile organic compounds before this vapor passes through either catalyst. This additional component may help provide efficient oxidation of volatile organic compounds. In one embodiment, the temperature of the vapor exiting the heat exchanger is 200–600° C. (390–1100° F.).

In some embodiments, the unsupported and the supported oxidation catalyst may be divided into separate sections or segments (with multiple segments being possible for one or both of the unsupported and supported catalysts) and the gas or vapor stream containing the volatile organic compounds passes through one part (section) at a time as it passes from the entrance to the exit of the oxidation catalyst system. There may be a gas motive power system to move the air containing the volatile organic compounds through the sections in controlled sequence. The gas motive power force is most commonly a fan but a pump can also be used. There may be a gas flow diverter in the gas conduit following each section to pass the air to either the following section or to a first gas outlet that passes the air out of the supported oxidation catalyst.

In general, there may be a gas flow diverter in the gas path or conduit of each section that can controllably direct the path of the vapor or gas stream flow. The gas flow diverter passes the vapor either to the following section in controlled sequence or to a gas outlet where it is passed to the vent and outside of the supported oxidation catalyst environment.

The sections of the supported oxidation catalyst system may have approximately the same or different amounts of surface area to contact the vapor containing the volatile organic compounds. The boundaries of the sections extending from one end to the other end of the catalyst may be perpendicular to, parallel to, angled with or surrounding of the flow of vapor containing the volatile organic compounds passing through the sections as long as the gas stream intimately and efficiently contacts the gas stream with the catalyst. In one non-limiting embodiment (box-like), the shape of a cross section of the supported oxidation catalyst perpendicular to the flow of vapor containing volatile organic compounds is a rectangle. The longitudinal boundaries are approximately parallel to each other and the boundaries of the sections are rectangles. The sections are arranged in a sequential grid that is formed by the intersection of the longitudinal boundaries with a plane perpendicular to the flow of vapor in the catalyst. A first section 1 is positioned in one corner of the grid and it can be in any of the four corners. The remaining sections may be numbered in numerical sequence in either the row or the column of the corner where section 1 is positioned. These numbers may be identification for a processing system or manual operator to assist in appropriately directing flow. The numbering sequence continues to the end of the row or column and then it begins in the adjacent row or column with the numbering sequence in the same direction as the first row or column. This numbering arrangement is continued until all of the sections are numbered for convenience.

In another embodiment (cylindrical), the shape of a cross section of the supported oxidation catalyst system perpendicular to the flow of air containing volatile organic compounds may be a circle or concentric circles (where the catalyst has the overall shape of a cylinder). The boundaries of the sections may be seen as concentric circles in a cross section perpendicular to the flow of vapor containing volatile organic compounds. The innermost circle may be the outside circumference of the first section and the numbering arrangement of the sections is from the first section to the section with the outermost circumference.

FIG. 1 is a top view of a box-like oxidation catalyst system 100, in which the shape of a cross section perpendicular to the flow of the vapor containing the volatile organic compounds is a rectangle, and the oxidation catalyst system 100 is divided into two sections 102, 104. One method for dividing the catalyst system 100 into two sections for a rectangular shaped catalyst is illustrated in the top view in FIG. 1 and the perspective view in FIG. 2. The bold line 106 is the boundaries of the sections that are substantially impervious to the vapor phase, such as the air/organic compounds mixture, but capable of transmitting heat. FIG. 1 is the monolith catalyst 100 divided into two sections 102, 104. The right area is the section 1 102 top view of section 102 which may for example be the unsupported catalyst region and the left area is the section 2 top view 104 of the supported catalyst region. FIG. 2 shows a perspective view of the catalyst 100 divided into two sections 102, 104. The vented gas stream from a printer (not shown) such as vapor containing the volatile organic compounds enters the oxidation catalyst system through the first gas inlet 120, passes through the section 1 gas inlet 122, passes into section 1 102 (arrow 112 shows the direction of flow), passes through section 1 102 and exits at the section 1 exit 108, passes through the section 1 gas outlet 124, passes through the section 1 gas conduit 126, passes through an optional gas flow diverter 134 in the section 1 gas conduit 126 where the vapor can be passed to either the first gas conduit 125 or to section 2 104. If the vapor is passed to section 2 104, the vapor passes through the section 2 inlet 128, passes through the section 2 entrance 110 (arrow 114 shows the direction of flow), passes through section 2, and exits at the section 2 exit comprising section 2 gas outlet 130, and passes through the section 2 conduit 132 (arrow 116 shows the direction of flow). Catalyst would fill section 1 and section 2, for example unsupported catalyst 121 (only a top cross-section portion is shown, for example) in section 1 102 and supported catalyst 123 (only a top cross-section portion is shown, for example) in section 2 104. The various enclosing structures for sections 102 and 104 may be readily openable by an operator so that catalyst in the interior may be easily replaced, or the various conduits and inlets and outlets may be removable so that the entire sections 1 102 and 2 104 may be replaced along with enclosed catalyst.

Control of the diverter 134 may be by manual control or automated control, as previously indicated. For example, a flow meter 131 may be present over the exit 108 such that upon measurement of flow rates, or excess hydrocarbon content after passing through a first section of catalyst a processor can determine if the diverter needs to send gas stream flow into section 2 104, or when the system has more options (as later described), what options to exercise in diverting the gas stream flow. The gas inlets and conduits 120, 122, 128, 110 and gas outlets and conduits 108, 124, 130, 132, 126, 125 are shown in this non-limiting figure as tubes or narrow cylinders, but may be of any size or shape that will allow the VOC laden gases to enter and exit the various sections of catalyst as needed.

Figure 4:
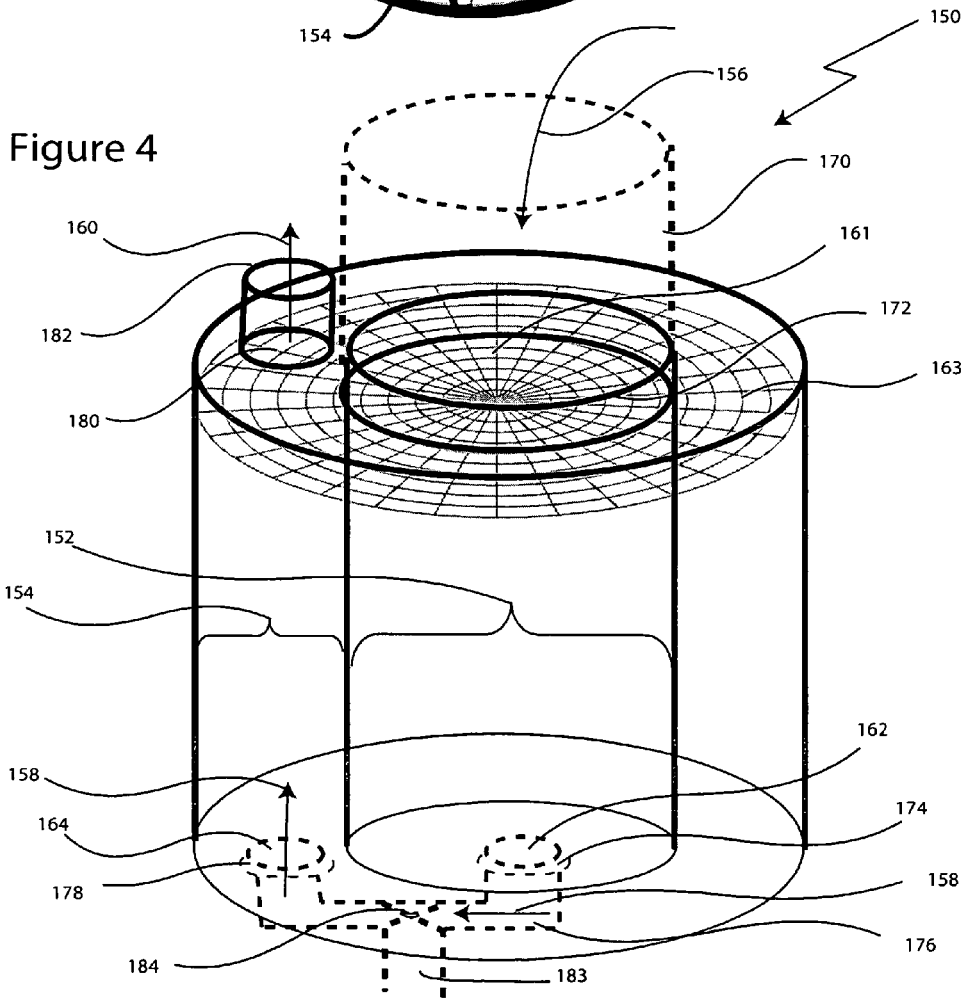
FIG. 4 is a perspective view of a cylindrical monolith oxidation catalyst, in which the shape of the catalyst is a cylinder, where the catalyst material is shown as only a cross-section and where the monolith oxidation catalyst is divided into two sections.

A preferred method for dividing the catalyst system into two sections for a substantially cylindrical catalyst system 150 is illustrated in the top view in FIG. 3 and the perspective view of the catalyst system 150 in FIG. 4. The bold lines 143, 141 are boundaries of the sections that are substantially impervious to the vapor containing the volatile organic compounds. FIG. 3 is a top view of the cylindrical catalyst system 150 divided into two substantially concentric sections 152 and 154. The innermost concentric circle 141 is the outside circumference of section 1 and the outermost concentric circle 143 is the outside circumference of section 2. The area inside of the innermost concentric circle may be a section 1 top view 152 of the first catalyst segment (e.g., the unsupported catalyst) and the area outside of the innermost concentric circle and inside of the outermost concentric circle may be the section 2 top view 154 of the second catalyst segment (e.g., the supported catalyst). For ease of understanding, the Figure shows a two section system, although more complex systems with more substantially concentric sections and more complex flows are also available, and may even be preferred. Lines 142, 144, 146 and 148 may represent additional barrier layers between sub-regions or smaller independent segments of the supported catalyst within outer catalyst region 154. With changing flow rates sensed by a flow sensor or different (and, for example, undesirable) concentrations of hydrocarbons sensed by a detector, or any other parameter sensed or measured that indicates a need for a change in catalytic activity, more or less catalyst may be brought into service by diverting the vapor flow through additional sections. For example, when flow is detected that marginally exceeds the capacity of catalytic activity that can be provided by catalyst within section 152, flow of the gas stream may be diverted (either before or after passage through the first section of catalyst) into the first ring of catalyst in second region 154, that is, the space between barrier 142 and barrier 141. There may be flow control diverters, switches, gates, vents, or other flow control elements that can gradually divert more and more of the gas stream into section 154, using more area, such as that sequentially encompassed within barriers 142, 144, 146, 148 and 143. Similarly, diverters, switches, gates, vents, or other flow control elements that can gradually divert more and more of the gas stream into section 154, using more area, such as that sequentially encompassed within radially separated areas, such as those bounded by barriers 145, 147 and 149. These systems require greater sophistication and elegance in design than the simpler two section 152 and 154 catalyst system 150 that is shown, but the operative principles are essentially the same.

Figure 5:
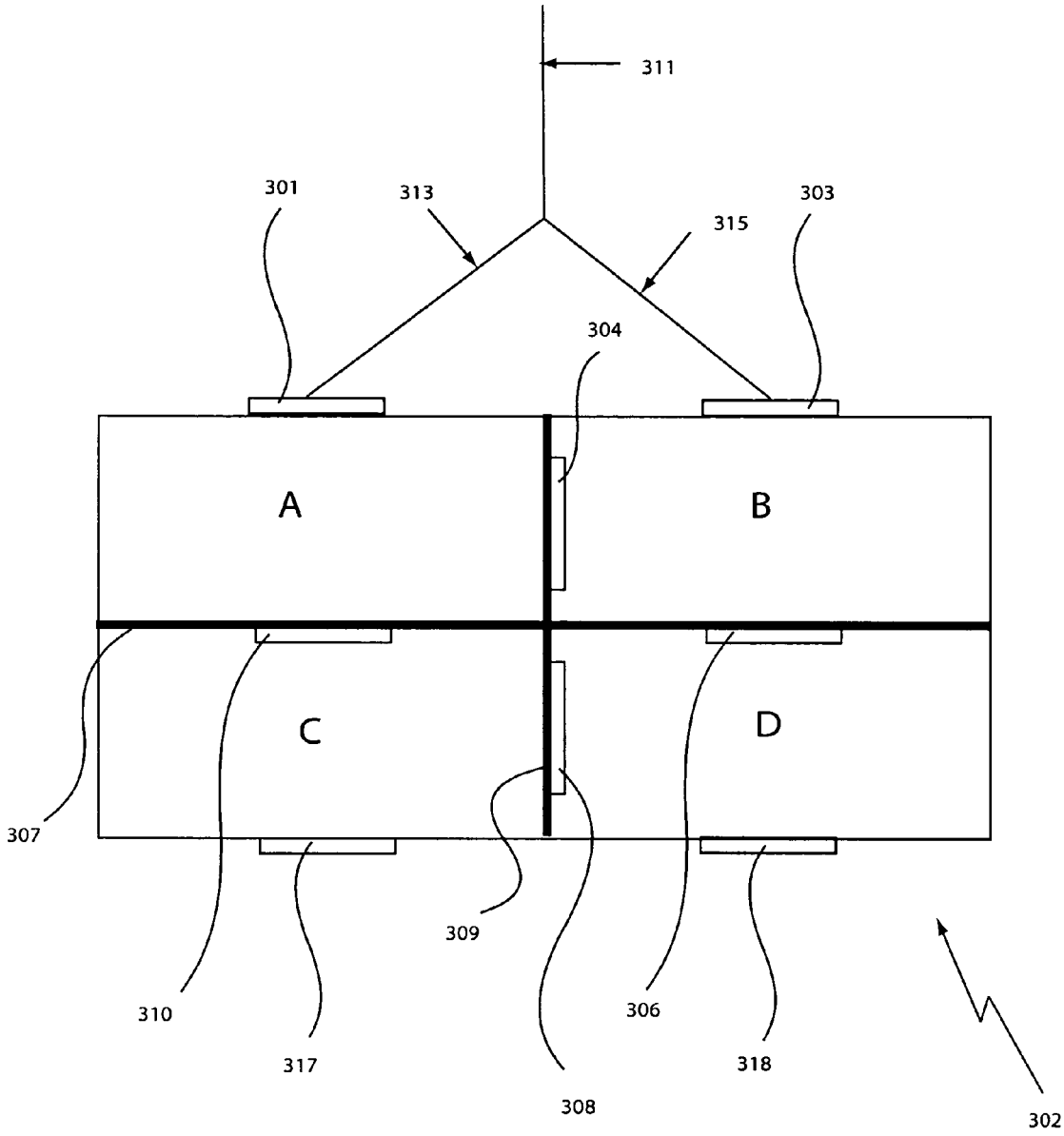
FIG. 5 is a schematic flow diagram of the air containing the volatile organic compounds in a box-like monolith oxidation catalyst that is divided into four sections.

FIG. 4 shows a perspective view of the substantially cylindrical catalyst system 150 of FIG. 3 divided into two sections 152 and 154. The catalyst material 161, 163, which may be supported or unsupported, is shown in FIG. 4 in only a cross-section view for figure simplicity. The air containing the volatile organic compounds (vapor) passes through the first gas inlet 170, passes through the section 1 gas inlet 172, passes through the section 1 entrance 152 (arrow 156 shows the direction of flow), passes through section 1 152 and passes through the section 1 exit 162, passes through the section 1 gas outlet 174, passes through the section 1 gas conduit 176, passes through an optional gas flow diverter 184 in the section 1 gas conduit where the gas can be passed to either the first gas conduit 183 or to section 2 154. If the gas stream is directed to section 2 154, the gas stream passes through the section 2 gas inlet 178, passes through the section 2 entrance 164 (arrow 158 shows the direction of flow), passes through section 2 154, and passes through the section 2 exit 180, passes through the section 2 gas outlet 182 (arrow 160 shows the direction of flow). For ease of illustration, this non-limiting Figures shows the first gas inlet 170 as having a diameter equal to that of the first section 152, though the first gas inlet 170 may be of any shape or dimension that will allow the VOCs to be admitted into the catalyst. Similarly, the gas inlets, conduits, and exits 162, 174, 176, 183, 178, 164 are shown as narrow tubes or cylinders, though they may also be of any shape or dimension that will allow the VOCs to be admitted into or out of section 2 of the catalyst Another alternative method is to divide a catalyst (e.g., of any geometric shape, but with a rectangle shown for convenience in FIG. 5) into four sections as for a rectangular-shaped or box-like catalyst is illustrated in the top view in FIG. 5. The bold lines 307 and 309 are the walls of the sections A, B, C and D that are substantially impervious to the air/organic compounds mixture. FIG. 5 is the catalyst system 302 divided into four sections A, B, C and D. The gas flow regulation through this four part system is also easily constructed once the concept is described. The system may have an unsupported catalyst in one or more sections (assume sections A and B for discussion). The vented gas stream flow from a printer (not shown) may initially enter section A of the unsupported catalyst through inlet 301. As long as the catalyst within section A is sufficient to effect the decomposition of hydrocarbon vapor, only that section A need be used. When information becomes available (as previously noted) that greater catalytic activity or greater surface area of catalyst is needed, either diverting system 304 to chamber B with additional unsupported catalysts, for example, may be opened, or diverting system 310 to section C may be opened to engage supported catalyst. Similarly, as needs require, diverting systems 306 and 308 may also be appropriately opened or closed in response to the determined catalytic response requirements of events and gas stream flow.

The walls of the sections do not need to be added to the catalysts if the gas channels in the catalyst are substantially impervious to the air containing the volatile organic compounds. The gas channels in a catalyst are normally substantially impervious to the air containing the volatile organic compounds. For example, for the monolith oxidation catalyst divided into two sections, the air containing the volatile organic compounds will enter the section 1 gas inlet. There needs to be a good attachment and seal of the section 1 gas inlet to the section 1 entrance. The attachment and seal must not be affected by the catalyst temperature, catalyst cycling temperature, heated air containing the volatile organic compounds, and the products of oxidation.

As noted earlier, the sections (as in FIG. 5) may be operated in parallel as well as in series. Parallel flow could be achieved for example from a vapor stream 311 from a printer (not shown) that is split into two paths 313 and 315 and then with sections A and C containing supported catalysts and sections B and D containing unsupported catalyst, streams 313 and 315 of similar initial compositions would respectively pass through vents or dispersing elements 301-310-317 through sections A and C while there would be parallel flow of stream 315 through vents or diverting elements 303-306-318 where the stream would be vented or collected. The catalyst content of the chambers could also be altered so that different catalysts and different catalyst sequences or treatment could be provided in parallel pathways as described above.

The air containing the volatile organic compounds (vapor) is passed through the supported oxidation catalyst that is divided into a plurality of sections and there may be at least one section of catalyst that is provided with a thermal system such as a resistance heater or the like. The air containing the volatile organic compounds is passed through the sections in an appropriate and selected sequence using gas motive power, for example. The gas motive force is most commonly a fan but a pump can also be used. The vapor is passed through a first section and then through any additional sections needed and any subsequent sections needed. The exhaust from the last section is passed to a vent or to a collection system.

The gas outlet of a section and the gas inlet of the following section may be approximately in the same plane or in different planes.

A processor may be used to adjust the printing operation if there needs to be a change. Any operating system (e.g., WINDOWS® OS, MAC OS, Linux) may be used, and directions may be provided by software, hardware or combinations thereof with microprocessors, processors, chips, boards, programmable arrays, and the like. A sensor or operator will send a signal to the processor and the processor will compare the signal to a target. The processor will adjust the process if the signal is either below or above the target depending on what is being measured. The different sensors in the oxidation process include, but are not limited to the following: unsupported oxidation catalyst temperature, supported oxidation catalyst temperature, heat exchanger temperature, hydrocarbon gas concentration sensor, carbon monoxide gas concentration sensor, carbon dioxide gas sensor, and pixel counter sensor (monitoring the total number of pixels to be printed).

There may be a sensor in the unsupported oxidation catalyst to measure the temperature of the unsupported oxidation catalyst. The sensor will measure the temperature and send a signal to the processor that indicates the temperature of the unsupported oxidation catalyst to the processor. The processor will compare this temperature to a target temperature. If the temperature is below the target temperature, it will activate one or more heating sources for the unsupported catalyst. It may use the heat of oxidation of the supported oxidation catalyst. Fans may push the heated vapor around the supported oxidation catalyst to the unsupported oxidation catalyst in ducts or without ducts. It may use heat of resistance by passing electricity through wires of the unsupported oxidation catalyst or it may pass electricity through wires that have been inserted into the unsupported oxidation catalyst. If the temperature is above the target temperature, the processor will pass room temperature air to the unsupported oxidation catalyst. Equivalently, there may be a sensor in the supported catalyst.

There may also be a sensor at the exit of the heat exchanger to measure the temperature of the air containing the volatile organic compounds (vapor) as it exits the heat exchanger. The sensor will measure the temperature and send a signal to the processor that indicates the temperature of the air containing the volatile organic compounds as it exits the heat exchanger. The processor will compare this temperature to a target temperature. If the temperature is below the target temperature, it will activate one or more heat sources. The processor may activate a heat source that uses the heat of oxidation of the unsupported oxidation catalyst. Fans may push the heated vapor around the unsupported oxidation catalyst to the heat exchanger in ducts or without ducts. The processor may use the heat of oxidation of the supported oxidation catalyst. Fans may push the heated vapor around the supported oxidation catalyst to the heat exchanger in ducts or without ducts. It may use the heat of resistance and place electrical resistance heaters in thermal contact with the heat exchanger and pass electricity through the electrical resistance heaters. It may use the heat of an infrared heat lamp to heat the heat exchanger. If the temperature is above the target temperature, it will pass room temperature air to the heat exchanger.

There may also be a sensor to measure the VOC concentration in the gas being exhausted from a printer to the environment. The sensor may be appropriately positioned, such as by way of a non-limiting example, in the first gas conduit adjacent to the vent. The processor will compare the VOC concentration to a prescribed concentration range. If the VOC concentration is above the prescribed concentration limit maximum, the processor will activate additional catalytic capacity. It may also activate the unsupported oxidation catalyst, additional sections of the supported oxidation catalyst in numerical order, and/or increase the temperature, such as to the maximum range of 500–600° C. of the unsupported oxidation catalyst and the supported oxidation catalyst. If the VOC concentration continues to be above the prescribed maximum concentration limit, it may decrease the printing speed in steps. Finally, if the concentration continues to be above the prescribed limit, it will stop the printer. If the VOC concentration is below the prescribed concentration limit minimum, the process may deactivate catalytic capacity. It may deactivate the unsupported oxidation catalyst and sections of the supported oxidation catalyst in reverse order.

There are many known ways of detecting gases that can provide this function, such as the use of diodes or semiconductors that change their electroluminescence of reflectance, or absorption, or luminescence when a concentration of gas contacts an active surface of the device. Such detection elements are shown, by way of non-limiting examples, in U.S. Pat. Nos. 4,364,995; 4,645,932; 4,752,588; 4,780,643. Acoustic wave device chemical sensors may be used, such as those shown, by way of non-limiting example, in U.S. Pat. Nos. 6,432,362; and 6,237,397.

Circuitry that measures electrical property changes in the ambient or contained air phase or gas streams in the printer which can be used to relate the changes to increased or altered VOC content in the gas phase or vapor stream can also be used. As the chemical nature of the volatile organic compounds that are present in the gas phase or vapor stream are known, the electrical effects of those specific VOC's in a gas phase or vapor stream can be predicted with a high degree of certainty. Measurements of the resistance, conductance, and/or dielectric properties of the phase or stream can be produced, and those properties can be correlated to a database or look-up table (electronic or physical) to determine what the VOC concentration is in the phase or stream. For example, air has a dielectric constant of 1.0 and Norpar carrier vapor (hydrocarbon emissions) has a dielectric constant of 2.01. U.S. patent application Ser. No. 10/879,895, filed Jun. 28, 2004, which is incorporated herein by reference, includes a sensor that provides a constant monitor for the dielectric constant of the atmosphere inside the printer (or alternatively, or additionally the dielectric constant of the printer emissions that are leaving the catalyst) and acts to disable the machine if the concentration reaches a predetermined threshold.

There may be a sensor to measure the carbon monoxide concentration in the gas being exhausted from a printer to the environment. The sensor could be positioned in the first gas conduit adjacent to the vent. The processor will compare the carbon monoxide concentration to a prescribed concentration limit range. If the carbon monoxide concentration is above the prescribed concentration limit maximum, the processor may activate additional catalytic capacity. It may activate the unsupported oxidation catalyst, additional sections of the supported oxidation catalyst in numerical order, and increase the temperature of the unsupported oxidation catalyst and the supported oxidation catalyst to the maximum range of 500–600° C. If the VOC concentration continues to be above the prescribed maximum concentration limit, it may decrease the printing speed in steps. Finally, if the concentration continues to be above the prescribed limit maximum, it may stop the printer. If the VOC concentration is below the prescribed concentration limit minimum, the processor may deactivate catalytic capacity. It may deactivate the unsupported oxidation catalyst and sections of the supported oxidation catalyst in reverse order.

There are many different devices for detecting the concentration of carbon monoxide in air. One technology for detecting carbon monoxide is a metal oxide semi-conductor (MOS), in which heated tin oxide reacts with carbon monoxide to determine the levels of carbon monoxide. There are also different electrolytic sensor detectors that are extremely sensitive in detecting carbon monoxide in air with a resolution of 1 ppm with an accuracy of 3%. There are electrochemical devices in which porous platinum electrodes catalyze electrode reactions of carbon monoxide and oxygen as the gases diffuse into the sensor. There are solid state ceramic carbon monoxide sensors that can detect carbon monoxide in air at part per million concentrations and respond in seconds. The carbon monoxide threshold limit can be set at a level between 5 and 200 ppm.

There may therefore be a sensor to measure the carbon dioxide concentration in the gas being exhausted from a printer to the environment. The sensor could be positioned in the first gas conduit adjacent to the vent. One skilled in the art knows that there are many different devices for continuously monitoring the concentration of carbon dioxide in air. The prescribed minimum concentration limit will be the target to determine if additional catalytic capacity is needed. The prescribed maximum concentration limit will be the target to determine if catalytic capacity can be deactivated. This is the opposite of the targets for VOC's and carbon monoxide. The prescribed maximum concentration is approximately 5,000 ppm which is the level recommended by OSHA PEL and by ACGIH TLV. The prescribed minimum concentration is not known. One skilled in the art knows that this minimum concentration can be determined by measuring the carbon dioxide concentration at the same time that the VOC concentration or carbon monoxide concentration is determined.

The processor can compare the carbon dioxide concentration to a prescribed minimum concentration limit. If the carbon dioxide concentration is below the prescribed concentration limit minimum, the processor may activate additional catalytic capacity because this means that not enough carbon dioxide is being produced from the oxidation of the volatile organic compounds. It may activate the unsupported oxidation catalyst, additional sections of the supported oxidation catalyst in numerical order, and increase the temperature of the unsupported oxidation catalyst and the supported oxidation catalyst to the maximum range of 500–600° C. If the carbon dioxide concentration continues to be below the prescribed minimum concentration limit, it may decrease the printing speed in steps. Finally, if the concentration continues to be below the prescribed limit minimum, it may stop the printer. If the carbon dioxide concentration is above the prescribed concentration limit maximum, the process may deactivate catalytic capacity. It may deactivate the unsupported oxidation catalyst and sections of the supported oxidation catalyst in reverse order.

A list of companies that sell continuous monitoring devices that measure the concentration of VOC's, carbon monoxide, and carbon dioxide in parts per million are listed below. VOC detectors that may be used in the practice of this invention may be obtained from such companies as: RKI Instruments, 1855 Whipple Rd., Hayward, Calif. 94544, Amko Systems, Inc., 6-250 West Beaver Creek Rd., Richmond Hill, Ontario L4B 1C7, Turner Designs, 2023 North Gateway, Suite 101, Fresco, Calif. 93727, Pem-Tech, Inc., 10808 Fallstone, Suite 325, Houston, Tex. 77099, and Delphian Products Gas Monitoring Technology, 220 Pegasus Ave., Northvale, N.J.

Carbon monoxide detectors that may be used in the practice of this invention may be obtained from such companies as: RKI Instruments, 1855 Whipple Rd., Hayward, Calif. 94544, MST, Inc., 11288 Breininger Rd., P.O. Box 87, Hicksville, Ohio, Liston Scientific Corp., 18900 Teller Ave., Irvine, Calif. 92612, Monitoring Instruments Products Division of Ducon Technologies, 19 Engineers Lane, Farmingdale, N.Y. 11735, Sick, Inc., 6900 W. 110th St., Minneapolis, Minn. 55438, and Monitoring Solutions, 4440-TS High School Rd., Suite D, Indianapolis, Ind. 46241.

Carbon dioxide detectors that may be used in the practice of this invention may be obtained from such companies as: OI Analytical, P.O. Box 9010, College Station, Tex. 77842, Liston Scientific Corp., 18900 Teller Ave., Irvine, Calif. 92612, Monitoring Instruments Products Division of Ducon Technologies, 19 Engineers Lane, Farmingdale, N.Y. 11735, Ebmet Corp., 680 Fairfield Court, P.O. Box 979, Ann Arbor, Mich. 48106, and Monitoring Solutions, 4440-TS High School Rd., Suite D, Indianapolis, Ind. 46241.

There may also be a sensor that relates expected vapor production to imaging usage of a printer. For example, a processor may receive signals from a count of the total number of pixels to be printed or the total number of pixels generated per unit of time at the laser scanning device prior to going through the printer. One skilled in the art knows that, in the raster image processor, a pixel count may be obtained for the print queue. A pixel is understood by those skilled in the art; in printer technology a pixel is approximated by an area that will be receiving a drop of ink or particle(s) of toner at the printer and depends on the printing resolution of the printer. The processor may determine the number of pixels over a time internally controlled by a crystal controlled clock. This information would be generated in the print buffer before the printer applied ink corresponding to the image data (pixels in that print buffer. One skilled in the art understands that for monochrome (e.g. black and white) printing, a single print buffer contains the total number of pixels to be printed. In multicolor printing however, the total number of pixels to be printed is the sum of all pixels in each of a plurality of print buffers corresponding to the primary colors (e.g. yellow, magenta, cyan, and black) to be printed. The processor may determine if the present activated catalytic capacity meets the known catalytic requirement. If there is not enough activated catalytic capacity, it may activate additional catalytic capacity before the printing for that print buffer begins. It may activate the unsupported oxidation catalyst, one or more sections of the supported oxidation catalyst in sequential order, and/or increase the temperature of the unsupported oxidation catalyst and/or the supported oxidation catalyst up to the maximum range of 500–600° C.

Numerous alternatives and equivalents and variations on the fundamental structures and processes taught in the provided description without deviating from the generic concepts taught herein. The specific descriptions, components, ingredients, and designs are intended to be examples of a generic concept and not absolute limitations on the practice of the technology broadly described.

What is claimed:

1. An apparatus for oxidizing volatile organic compounds from an electrographic printing apparatus comprising:

a) a collection system that collects volatile organic compounds in a gas stream within an electrographic printer body;

b) a mass transfer element transmitting the gas stream to a catalytic treatment system, c) the catalytic treatment system comprising separate contact regions for an unsupported oxidation catalyst and a supported oxidation catalyst, wherein the collection system is connected to an inlet from the electrophotographic printing apparatus vapor stream.

2. The apparatus of claim 1 further comprising a gas motive source.

3. The apparatus according to claim 2 wherein the unsupported oxidation catalyst has a structure selected from the group consisting of: powder, fabric, a wire, a 2-dimensional array of wires, and a 3-dimensional array of wires.

4. The apparatus of claim 1 further comprising:

a diverter system that can direct the gas stream to paths selected from the group consisting of: the unsupported catalyst only, the supported catalyst only, first the unsupported catalyst and then the supported catalyst, and first the supported catalyst and then the unsupported catalyst.

5. The apparatus according to claim 1 further comprising a heat source thermally coupled to the unsupported oxidation catalyst.

6. The apparatus according to claim 1 further comprising a heat source thermally coupled to the supported oxidation catalyst.

7. An apparatus for oxidizing volatile organic compounds from an electrographic printing apparatus comprising:

a) a collection system that collects volatile organic compounds in a gas stream within an electrographic printer body;

b) a mass transfer element transmitting the gas stream to a catalytic treatment system, c) the catalytic treatment system comprising separate contact regions for an unsupported oxidation catalyst and a supported oxidation catalyst d) a diverter system that can direct the gas stream to paths selected from the group consisting of: the unsupported catalyst only, the supported catalyst only, first the unsupported catalyst and then the supported catalyst, and first the supported catalyst and then the unsupported catalyst, and wherein the diverter system is capable of delivering the gas stream first to the unsupported catalyst and then to either a venting system in the printer body or to the supported catalyst and a diverter system that can direct the gas stream to paths selected from the group consisting of: the unsupported catalyst only, the supported catalyst only, first the unsupported catalyst and then the supported catalyst, and first the supported catalyst and then the unsupported catalyst.

8. The apparatus of claim 7 wherein there are at least two sections within the catalytic treatment system consisting of a first section of unsupported catalyst and a second section consisting of supported catalyst.

9. The apparatus according to claim 7 wherein the unsupported oxidation catalyst has a structure selected from the group consisting of: powder, fabric, a wire, a 2-dimensional array of wires, and a 3-dimensional array of wires.

10. The apparatus according to claim 9 wherein the unsupported oxidation catalyst consists of a metal selected from the group consisting of: platinum, palladium, rhodium, ruthenium, copper, chromium, cerium, manganese, iron, nickel, tin, zinc, aluminum, zirconium, tungsten, vanadium, and alloys thereof.

11. The apparatus according to claim 7 wherein the supported oxidation catalyst is an oxidation catalyst comprising:

a) a support material, and b) a catalytic material thermally engaged to the support material.

12. The apparatus according to claim 11 wherein the support material comprises at least one ceramic material selected from the group consisting of: alumina, alumina-silica magnesia, alumina-titanate, alumino-silicates, aluminum-chromium oxide, aluminum-zirconium oxide, cordierite, cordierite-alpha-alumina, magnesium silicates, mullite, petallite, silica, silica-alumina, silicon nitride, sillimanite, spodumene, titania, zircon mullire, zircon, zirconium, zirconium oxide, and zirconium silicate.

13. The apparatus according to claim 11 wherein the catalytic material is at least one metal selected from the group consisting of: platinum, palladium, rhodium, ruthenium, copper, chromium, cerium, manganese, iron, nickel, tin, zinc, aluminum, zirconium, tungsten, vanadium, and alloys thereof.

14. The apparatus according to claim 7 further comprising a heat source thermally coupled to the unsupported oxidation catalyst.

15. The apparatus according to claim 14 wherein the heat source thermally coupled to the unsupported oxidation catalyst comprises at least one heat source selected from the group consisting of chemical reaction heating system; convection heating system; conductive heating system; and electrical resistance heating system.

16. The apparatus according to claim 14 wherein the temperature provided by the heat source is from about 200° C. to about 600° C.

17. The apparatus according to claim 7 further comprising a heat source thermally coupled to the supported oxidation catalyst.

18. The apparatus according to claim 17 wherein the heat source thermally coupled to the supported oxidation catalyst is at least one heat source selected from the group consisting of: heat of oxidation of the unsupported oxidation catalyst, heat of oxidation of the supported oxidation catalyst, heat of electrical resistance heating, and heat of an infrared heat lamp.

19. A component for decomposition of hydrocarbon gas or vapor in a gas stream from an electrophotographic printer that generates hydrocarbon vapor, the component comprising:

at least two separate compartments;

the at least two separate compartments comprising a first compartment with an unsupported catalyst and a second compartment comprising a supported catalyst;

the gas stream flow path into the first compartment;

a gas stream control component that enables at least some of the gas stream to be diverted to the second compartment before or after the at least some of the gas stream has entered the first compartment; the component being connected to a vapor stream from an inlet from the electrophotographic printer.

20. The component of claim 19 wherein both the supported catalyst and the unsupported catalyst comprise oxidation catalysts.

21. The component of claim 19 wherein a heating system is provided to heat the unsupported catalyst in the first compartment.

22. The component of claim 19 wherein the gas stream control component is able to allow gas flow in a path selected from the group consisting of a) into the first compartment and b) into the first compartment and then into the second compartment.

23. The component of claim 22 wherein heat of reaction from the first component is conducted to catalyst in the second component by way of gas flow.

24. An apparatus for oxidizing volatile organic compounds from an electrographic printing apparatus comprising:

a) a collection system that collects volatile organic compounds in a gas stream within an electrographic printer body;

b) a mass transfer element transmitting the gas stream to a catalytic treatment system, c) the catalytic treatment system comprising at least two separate contact regions, a first one of the at least two contact regions comprising an unsupported oxidation catalyst and a second one of the at least two contact regions comprising a supported oxidation catalyst wherein the at least two contact regions are adjacent to each other with a single discontinuous wall separating the at least two contact regions.

25. The apparatus of claim 24 further comprising a gas motive source.

26. The apparatus of claim 24 further comprising:

a diverter system that can direct the gas stream to paths selected from the group consisting of: the unsupported catalyst only, the supported catalyst only, first the unsupported catalyst and then the supported catalyst, and first the supported catalyst and then the unsupported catalyst.

27. An apparatus for oxidizing volatile organic compounds from an electrographic printing apparatus comprising:

a) a collection system that collects volatile organic compounds in a gas stream within an electrographic printer body;

b) a mass transfer element transmitting the gas stream to a catalytic treatment system, c) the catalytic treatment system comprising at least two separate contact regions, a first one of the at least two contact regions comprising an unsupported oxidation catalyst and a second one of the at least two contact regions comprising a supported oxidation catalyst wherein the at least two contact regions are adjacent to each other with a single discontinuous wall separating the at least two contact regions, a diverter system that can direct the gas stream to paths selected from the group consisting of: the unsupported catalyst only, the supported catalyst only, first the unsupported catalyst and then the supported catalyst, and first the supported catalyst and then the unsupported catalyst and wherein the diverter system is capable of delivering the gas stream first to the unsupported catalyst and then to either a venting system in the printer body or to the supported catalyst.

* * * * *